US005588453A

United States Patent [19]

Fraysher

[11] Patent Number: 5,588,453

[45] Date of Patent: Dec. 31, 1996

[54] MANICURE DEVICE

[76] Inventor: Mary A. Fraysher, 660 Springhill Dr., Hurst, Tex. 76054

[21] Appl. No.: 502,123

[22] Filed: Jul. 13, 1995

[51] Int. Cl.[6] ..... A45D 29/18

[52] U.S. Cl. ..... 132/76.4; 132/75.6; 132/73; 451/538

[58] Field of Search ..... 132/73, 73.5, 75.6, 132/76.4; 451/523, 525, 538, 552, 557

[56] References Cited

U.S. PATENT DOCUMENTS

| | | | |
|---|---|---|---|
| 2,469,586 | 5/1949 | Wallace | 451/525 |
| 2,557,175 | 6/1951 | Cortes | 132/76.4 |
| 3,318,318 | 3/1964 | Gewirz | 132/76.4 |
| 3,557,496 | 1/1971 | Martin | 451/523 |
| 3,809,101 | 5/1974 | Shimizu | 132/76.4 |
| 4,422,465 | 12/1983 | Haga | 132/76.4 |
| 4,537,207 | 8/1985 | Gilhaus | 132/76.4 |
| 4,559,957 | 12/1985 | Hokama | 132/73 |
| 4,621,461 | 11/1986 | Martin | 451/523 |
| 4,621,465 | 11/1986 | Pangburn | 51/392 |
| 4,683,898 | 8/1987 | Lojovich | 132/73 |
| 5,163,455 | 11/1992 | Pointe et al. | 132/73 |

FOREIGN PATENT DOCUMENTS

| | | | |
|---|---|---|---|
| 142316 | 11/1949 | Australia | 43.7 75.5 |
| 627486 | 9/1961 | Canada | 132/76.4 |
| 349692 | 3/1922 | Germany | 132/76.4 |
| 3502 | of 1891 | Switzerland . | |
| 25115 | of 1911 | United Kingdom . | |

*Primary Examiner*—Gene Mancene
*Assistant Examiner*—Pedro Philogene
*Attorney, Agent, or Firm*—Baker & Botts, L.L.P.

[57] ABSTRACT

Manicuring device (10) is provided that comprises an elongated cylindrical body (12) having a tapered end (14) and a second end (16) distal to the tapered end (14). An abrasive surface (18) is affixed to the outer surfaces of the body (12) near the end (16). Perforation lines (20) and (22) are disposed along intervals of the abrasive surface (18). The device (10) may be used to hone the inner surface of a fingernail or toenail.

6 Claims, 1 Drawing Sheet

MANICURE DEVICE

TECHNICAL FIELD OF THE INVENTION

This invention relates in general to the field of personal hygiene and grooming and more particularly to an improved manicure device and method of use.

BACKGROUND OF THE INVENTION

Common nail files are ordinarily constructed by placing abrasive material on a flat or nearly flat surface. These devices are very useful for trimming and filing the ends of the nails and for smoothing the outer surface of the nail. However, the flat shape or nearly flat shape of the abrasive surface prevents these devices from being used to smooth and hone the inner surface of the nail.

In addition, conventional nail files and manicure devices are usually disposable systems. Once the abrasive material is worn out, the file is thrown away.

Accordingly, a need has arisen for a manicure device that provides an abrasive surface that can be used to hone the underside of the nail. In addition, a need has arisen for a manicure device that includes reusable abrasive surfaces to prolong the useful life of the device.

SUMMARY OF THE INVENTION

In accordance with the teachings of the present invention, a manicure device is provided that substantially eliminates and reduces disadvantages with prior systems and methods of use.

In accordance with one embodiment of the present invention, a manicure device is provided that comprises a cylindrical body with a first tapered end and a second end distal from the tapered end. The device comprises abrasive material which is disposed on the outer surface of the body including the second end and portions of the body proximate the second end. The abrasive material and the outer surface of the body are perforated at intervals along the portions of the body covered by the abrasive material such that the body and the abrasive material can be fractured to provide for the use of a new portion of the abrasive material proximate the fracture point.

According to an alternate embodiment of the present invention, a elliptically cylindrical body is provided with a tapered first end and a second end distal from the tapered first end. An abrasive sheath is provided that is shaped to slip onto and cover the second end of the body and portions of the outer surface of the body near the second end.

BRIEF DESCRIPTION OF THE DRAWINGS

A more complete understanding of the advantage of the present invention may be acquired by referring to the accompanying drawings in which like reference numbers indicate like features and wherein.

DETAILED DESCRIPTION OF THE INVENTION

Figure 1:
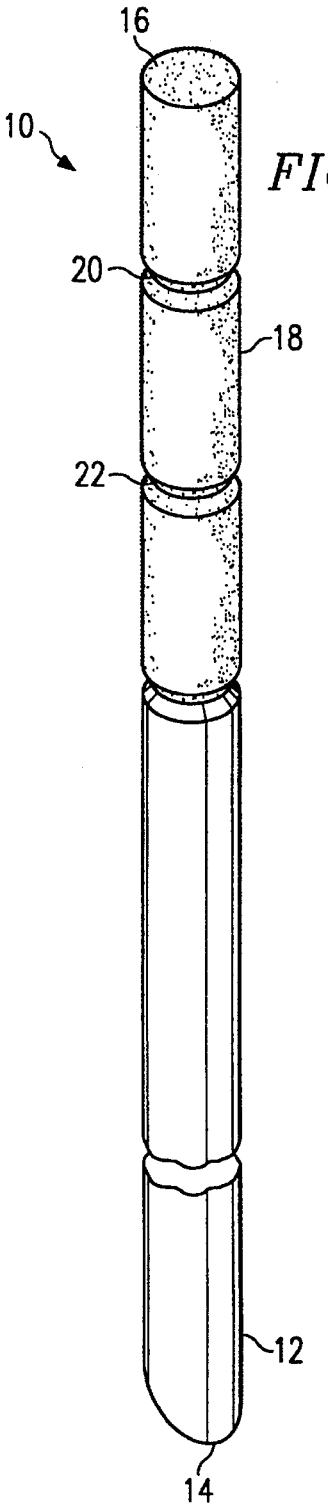
FIG. 1 is a diagram illustrating a first embodiment of the manufacturing device of the present invention.

FIG. 1 illustrates a manicuring device indicated generally at 10 which comprises an elongated cylindrical body 12. Body 12 may be constructed of any rigid material such as wood or plastic. Body 12 comprises a first tapered end 14 and a second end 16. Device 10 further comprises an abrasive material 18 which is fixed to the outer surfaces of body 12 near second end 16. The surface of the abrasive material 18 and the outer surface of body 12 are perforated at perforation lines 20 and 22 evenly spaced along the entirety of the abrasive material 18.

Figure 2:
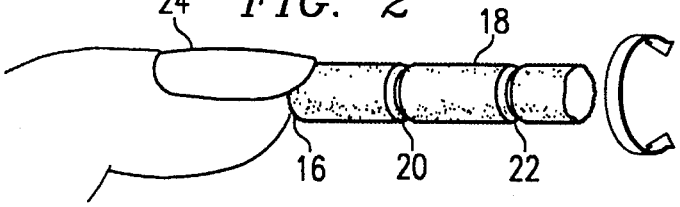
FIG. 2 is a diagram illustrating the method of use of the manicuring device of the present invention.

The abrasive material 18 may comprise fine, medium or coarse emery granules such as sand or other abrasive compounds which may be fixed to the outer surface of body 12 either directly or by fixing them to a paper sheath and then fixing the paper sheath to body 12. In operation, the manicuring device 10 may be used to manipulate the cuticles of a person's nails by using the tapered end 14. In addition, the cylindrical shape of body 12 allows the abrasive material 18 to be applied to the inner surface of the nail to hone the inner surfaces of the nail by rotating the device 10 as shown in FIG. 2. Referring to FIG. 2, the second end 16 with the abrasive material 18 disposed on the outer surfaces of body 12 is shown applied to the inner surface of a person's nail 24.

It is common for abrasive surfaces to wear down and become less useful after a certain amount of use. After the abrasive surface 18 proximate the second end 16 has been used enough to degrade the performance of the abrasive surface 18, a user of device 10 can simply fracture the body 12 along perforation 20 and a new portion of the abrasive surface 18 is made available.

Figure 3:
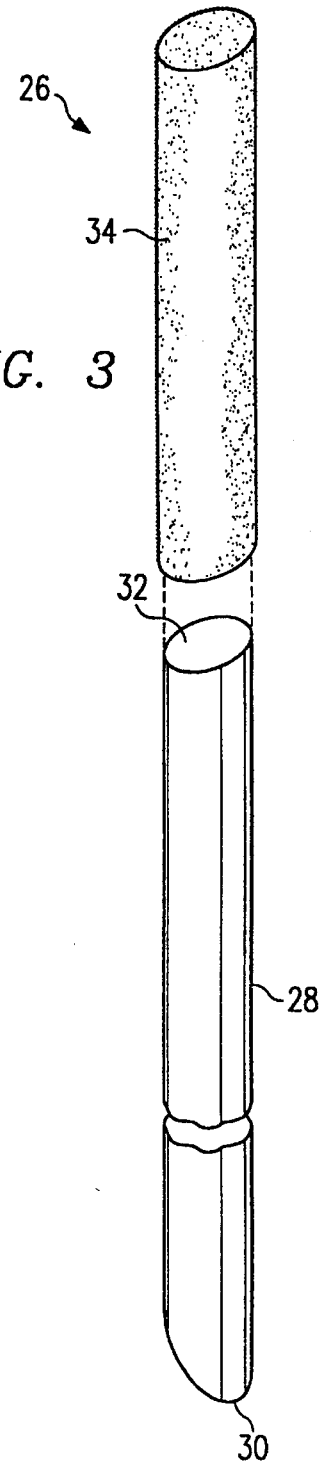
FIG. 3 is a diagram illustrating a second embodiment of the manicuring device of the present invention.

FIG. 3 illustrates an alternate embodiment of the present invention embodied in a manicuring device indicated generally at 26. Device 26 comprises an elliptically cylindrical body 28 which comprises a first tapered end 30 and a second end 32. Tapered end 30 may be used to manipulate the cuticle of a user of device 26 just as tapered end 14 described previously. Device 26 also comprises an abrasive sheath 34 which is of a size and shape to enable the sheath to slip over end 32 and snugly cover the outer surface of body 28 proximate end 32. Sheath 34 may be constructed of plastic or paper with abrasive material fixed to the outer surface of the paper or plastic layer. The abrasive sheath 34 may also comprise a sheath of cloth having sand or other similar abrasive material affixed to the outer surface thereof. Sheath 34 is also of elliptical shape so as to fit snugly about body 28.

The body 28 and sheath 34 both have a cross-sectional shape, such as an ellipse, that allows for the abrasive outer surface of sheath 34 to be used to hone the inner surface of a user's nail without causing the sheath 34 to rotate about the outer surface of the body 28. Although the embodiment of the device 26 is shown to have an elliptical shape, it should be understood that any cross-sectional shape which prevents the rotation of sheath 34 about body 28 would also work and the fact that an elliptical shape has been used to describe the advantages of the present invention should not be construed to limit the scope of the present invention to this or any particular shape or embodiment.

Although the present invention has been described in detail, it should be understood that various changes, alterations, substitutions and modifications may be made to the teachings herein without departing from the spirit and scope of the present invention, which is solely defined by the appended claims.

What is claimed:

1. A manicuring device for use in honing a nail of a user having an inner surface, the device comprising:

an elongated cylindrical body having an outer surface and a first tapered end and a second end distal from the first tapered end;

an abrasive surface affixed to the outer surface of the body proximate the second end; and the abrasive surface and the body comprising a perforation line comprising perforations passing through the abrasive surface and partially into the body, the perforation line surrounding the cylindrical body at a constant distance from the second end of the body such that the user of the device may use the abrasive surface to hone the inner surface of the user's nail and may fracture the abrasive surface and the body at the perforation line to allow for the use of a portion of the abrasive surface proximate the perforation line.

2. The device of claim 1 wherein the abrasive surface comprises sand fixed to a sheet of paper, the sheet of paper fixed to the outer surface of the body.

3. The device of claim 1 wherein the device of claim 1 comprises sand fixed to the outer surface of the body.

4. The device of claim 1 wherein the cross-section of the body is a circle.

5. The device of claim 1 wherein the body comprises wood.

6. The device of claim 1 wherein the body comprises plastic.

* * * * *